US006369896B1

(12) United States Patent
Castello et al.

(10) Patent No.: US 6,369,896 B1
(45) Date of Patent: Apr. 9, 2002

(54) METHOD FOR VISUALLY INSPECTING TEXTILE GARMENTS, AND A SYSTEM FOR IMPLEMENTING SAID METHOD

(75) Inventors: Antoni Llorens Castello; Albert Sanfeliu Cortes, both of Barcelona (ES)

(73) Assignee: Cognivision Research, S.L. (ES)

( * ) Notice: Subject to any disclaimer, the term of this patent is extended or adjusted under 35 U.S.C. 154(b) by 0 days.

(21) Appl. No.: 09/348,901

(22) Filed: Jul. 6, 1999

Related U.S. Application Data

(63) Continuation-in-part of application No. PCT/ES97/00259, filed on Nov. 3, 1997.

(51) Int. Cl.[7] ..... G01N 21/88
(52) U.S. Cl. ..... 356/430; 356/238.1
(58) Field of Search ..... 356/429, 430, 356/238.1

(56) References Cited

U.S. PATENT DOCUMENTS

| | | | | | |
|---|---|---|---|---|---|
| 3,826,062 | A | * | 7/1974 | Lewis et al. | 53/255 |
| 4,491,255 | A | * | 1/1985 | LaChapelle | 223/37 |
| 5,261,579 | A | * | 11/1993 | Propach et al. | 223/77 |
| 5,497,235 | A | * | 3/1996 | Bell | 356/430 |
| 5,703,688 | A | * | 12/1997 | Bell | 365/430 |
| 5,904,279 | A | * | 5/1999 | Bertram et al. | 223/112 |

* cited by examiner

*Primary Examiner*—Richard A. Rosenberger
(74) *Attorney, Agent, or Firm*—Jensen & Puntigam, P.S.

(57) ABSTRACT

The present invention concerns a method for visually inspecting tubular garments such as socks, sleeves, stockings, panties or the like. The article is loaded onto or unloaded from a support or stretcher, and the article is checked or inspected by means of a computer-aided vision system during the loading onto or unloading off of the support or stretcher.

18 Claims, 2 Drawing Sheets

METHOD FOR VISUALLY INSPECTING TEXTILE GARMENTS, AND A SYSTEM FOR IMPLEMENTING SAID METHOD

This is a continuation-in-part of co-pending Internationl Application PCT/ES97/00259 filed on Nov. 3, 1997 designating the United States.

FIELD OF THE INVENTION

The present invention concerns a method for visually inspecting all kinds of tubular textile garments such as socks, sleeves, stockings, panties or the like, of the type comprising a first stage in which the article is loaded onto or unloaded from a support or stretcher, and a second stage in which said article is checked or inspected by means of a computer-aided vision system operating by means of an image acquisition stage and a final stage in which the acquired images are processed for thus detecting the flaws.

The devices of the above-mentioned type do generally comprise a contactless inspection based on a digital processing of images taken from different positions by means of a traveling motion executed with a mechanical system for positioning the system for the digital acquisition of said images.

RELATED PRIOR ART

As a background of the invention can be cited the report entitled "Inspección visual de prendas a gran velocidad", published in the magazine *Automática e Instrumentación, October* 1994, no. 47, pages 70–74, A. Llorens Castelló, A. Sanfeliu, J. J. Souto, describing a system for automatically inspecting panties for flaws, said system consisting of three main modules:

- a mechanical module for automatically loading the garment onto a support and moving a lighting and camera assembly;
- a circuitry module consisting of three circuit cards: a memory card with a 16 MB RAM with a line scan CCD camera input, an image preprocessing card whose core is comprised of the INP1000 systolic processor specially developed for the system, and a card for the visualization of the panty images, together with the corresponding software programs for access to the cards;
- the image processing software programs implementing all the algorithms for processing said images and detecting the flaws for their ulterior rating.

The system operates as follows: The undyed panty is vertically mounted on a stretcher thus allowing to illuminate it and to acquire its image during the vertical travel of a line scan CCD camera of 1024 "pixels" (picture elements) capturing the image line by line at right angles to the stretcher. The digititalized data are stored in the memory card, from where they are sent to the preprocessing card to be transmitted from there to a module for the extraction of characteristics and for their ulterior rating. Said stretcher has been provided to be shifted to place itself in front of the lighting and camera assembly, as well as to be turned such that the camera can thus when moving scan both sides of the garment.

The number and variety of the flaws to be controlled, and the frequency of the false alarms produced by seam shadows, overstressing of the fiber and other causes result in a very complex and costly image processing system.

One of the most significant problems inherent in the above-mentioned application derives from the need to correctly rate the flaws regardless of the type of material, garment size, finish and above all the tension to which the garment is subjected during the automatic mounting process, this entailing a high degree of parametrization of the algorithms implemented.

It is apparent that the described embodiment consists in a specialized machine, the system not being hence designed to be applied in textile or other machines already operating in the market.

The traveling motion of the lighting and camera assembly requires a space availability for said function requiring a predetermined free area.

The use of a line scan CCD camera (that scans the area to be inspected) involves long process times.

The lighting means employed by the described system comprise several fluorescent lamps strategically placed to obtain a correct illumination during the whole travel of the camera, this again imposing limitations when it comes to generalizing this application for its use with the standard machines that are commercially available in the market.

SUMMARY OF THE INVENTION

The object of the present invention consists in a method and system for visually inspecting tubular textile garments allowing to obviate the above-mentioned problems and to notably improve the efficiency of the system, and also allowing its implementation by means of a stationary image acquisition device of reduced dimensions.

The system being herein provided is essentially characterized in that it comprises a stationary camera and light source on an inspection area wherein the article to be checked is moved being kept under a predeterminated tension o a support or stretcher, and the method consists essentially in carrying out the inspection simultaneously with the introduction or egression of the finished article, tinted or not, onto or from a support such as a stretcher, with the essential particularity that said introduction of the article is carried out in the inspection area while being focused by said camera, uniformly illuminated and under a predetermined tension that is kept constant throughout the process. This results in said preset, constant tension giving the textile a uniform texture such that the distance between two filling or warp yarns is at all times smaller than a portion of any one of the flaws to be detected, which can thus be then correctly discriminated.

The stages of the method are detailed in claim 2 (20), and other particularities of the process appear in appended claims 3 (21) to 6 (24).

The essential characteristics of the system are on heir part detailed in claim 7 (25).

Other details of interest of the proposed system appear in appended claims 8 (26) to 18 (36).

BRIEF EXPLANATION OF THE DRAWINGS

For a better understanding of the invention follows a detailed description of a possible embodiment cited only by way of an illustrative, non limiting example with reference to two sheets of drawings accompanying this specification.

In said drawings.

DETAILED DESCRIPTION OF THE PREFERRED EMBODIMENT

Figure 1:
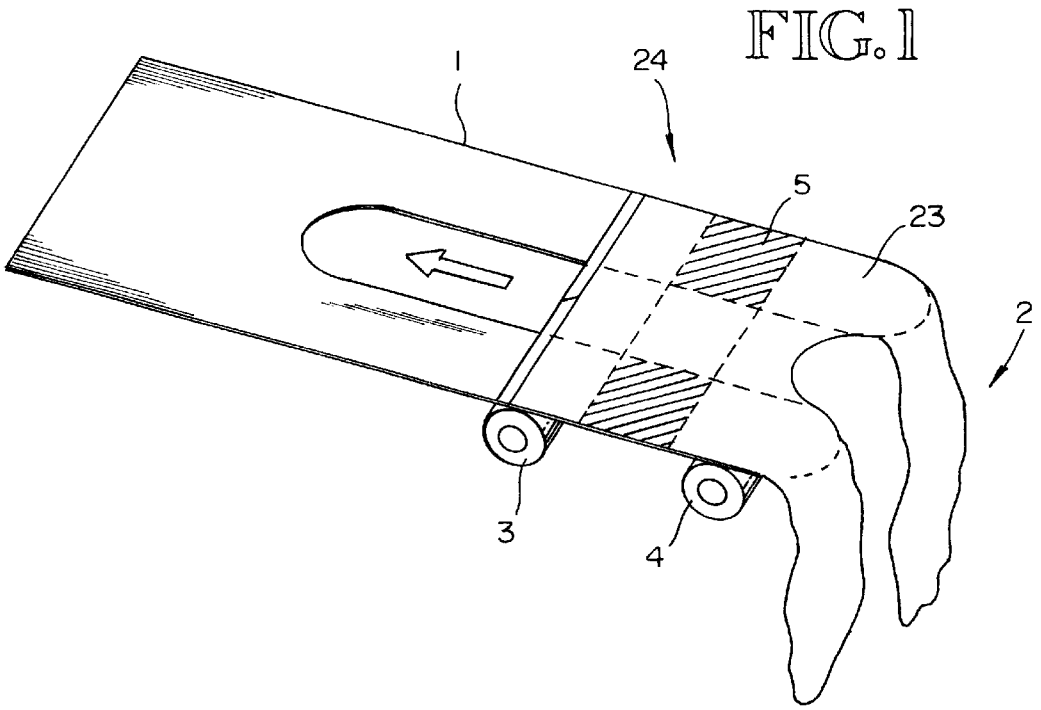
FIG. 1 shows a perspective view of a textile garment being laded onto a support or stretcher.

At numeral 1 is indicated in FIG. 1 a support or stretcher onto which a tubular textile garment 2 (a panty in this case) is being loaded in order to be inspected by means of image capturing means and lighting means simultaneously with said loading operation. In order to obtain a constant loading speed and most importantly a constant tension in the textile of the garment to be inspected both in the transversal and longitudinal direction throughout the whole operation mechanical loading mans have ben provided including in this example a driving roller 3 driven by a motor (not shown) and a driven roller 4 that can turn freely while opposing a frictional resistance to be preset as a function of each article, said rollers 3, 4 being arranged under stretcher 1 adjacent to distal ends of garment 2 between which the area to be scanned is defined. This results in the garment being grabbed between each of said rollers 3, 4 and the stretcher 1. Driving roller 3 is positioned ahead of driven roller 4, such that when said driving roller 3 turns in the advancing direction it drives by friction garment 2 thus advancing it in the direction shown by the arrow in FIG. 1, whereas driven roller 4 is driven by said garment 2 thus turning while opposing a predetermined resistance to the turning motion, said resistance providing a constant tension (both in the transversal and longitudinal direction) in the textile of said garment 2 while this latter advances with a uniform speed. FIG. 1 shows as well a partially or totally opaque plane 5 whose function will be described below. The inspection process can be equally carried out during the loading or unloading of garment 2 onto or from the support or stretcher 1, both on one only side or simultaneously on both sides of said garment 2.

Figure 2:
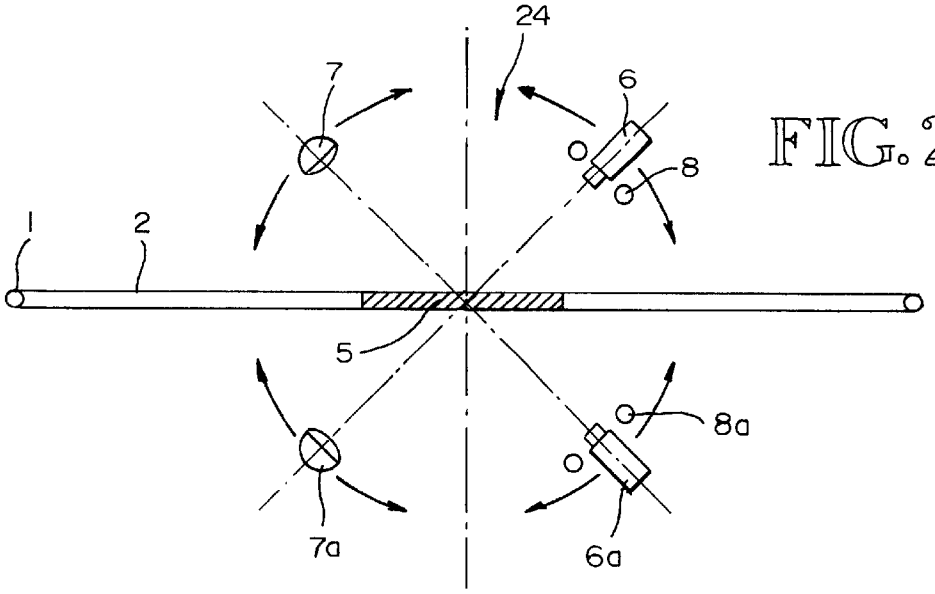
FIG. 2 is a cross-sectional drawing illustrating the different arrangements that can be adopted by the image capturing means and the lighting means as per this invention.

FIG. 2 illustrates image capturing means comprising, for example, a line or matrix scan CCD or MOS camera 6 (although other technologies are also feasible such as that of the CMOS camera), and lighting means consisting in a fluorescent or laser light source 7, said CCD camera 6 and light source 7 being stationary and being each arranged in one of the quadrants delimited by the plane on which the garment to be inspected is stretched (plane of the support stretcher 1) and a vertical plane that is perpendicular to the area to be scanned and centrally located with respect to it. With such an arrangement the textile of garment 2 reflects the light emitted by light source 7, said light being then captured by the CCD camera 6. The CCD camera 6 and the light source 7 can be positioned in different positions, since for example the CCD camera 6 can be positioned in a quadrant above the textile of garment 2, and a light source 8 can be situated in the same quadrant behind the camera itself in order not to dazzle it, and can advantageously have a ring shape. It is also to be noted that this system offers the possibility of simultaneously scanning both sides of an article, for such a purpose arranging both above and below said garment an assembly formed by a camera 6, 6*a* and a light source 7, 7*a* in each case situated in opposite quadrants. Since in this latter case the light sources are directly facing the cameras of the opposite side, in the case of transparent articles to be inspected it has been foreseen to interpose a totally or partially opaque plane 5 in order to avoid the occurrence of glaring phenomena in the corresponding cameras 6. The upper and lower cameras 6 and 6*a* can also in this arrangement comprise each a rear annular light source 8.

Figure 3:
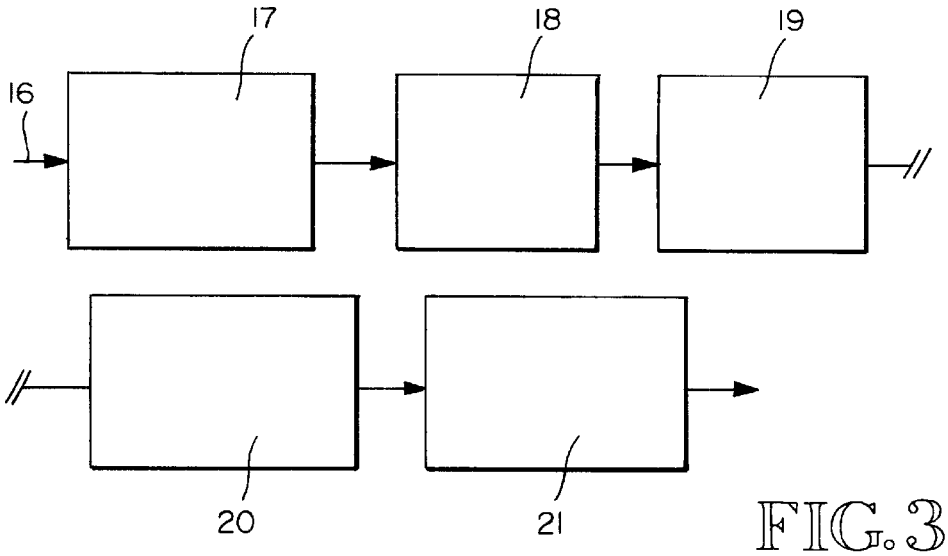
FIG. 3 is a block diagram explaining how the process stages follow each other in the method for visually inspecting tubular textile garments.

Block diagram of FIG. 3 allows to graphically follow the stages through which an image captured by the CCD camera 6 is processed up to the rating of the detected flaw types. In said diagram numeral 16 indicates an image captured by the CCD camera 6 which is firstly subjected to a digitilizing 17 in order to thus allow said image 16 to be processed in a computer system. The texture of the textile 23 is thereupon eliminated in block 18 by means of an image 16 filtering process after which only those elements representing alterations in the textile 23 are visible, this process being uniquely facilitated by the application of a constant tension to the garment in the area to be scanned, this allowing to eliminate the image background by comparison with standards. After a flaw emphasizing process in block 19 the flaw detection and extraction is thereupon carried out in block 20 by means of a simultaneous double threshold technique to be described below. In block 21 the flaw characterization is finally carried out by comparison with predetermined patterns or standards thus then arriving to a rating 22 of said flaws.

Figure 4:
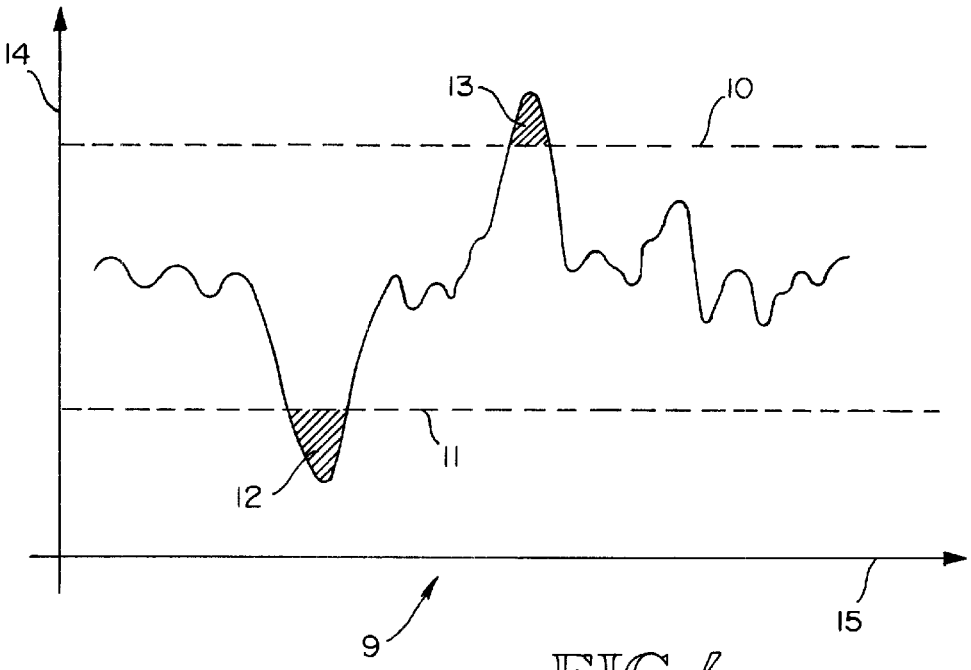
FIG. 4 exemplifies a graph representing the evolution of the grey levels assigned to the digitalized signal from each array light sensitive sensor (photosensor) of the camera throughout a given inspection.

FIG. 4 shows a graph on coordinate axes displaying the evolution of the proportion of light which after having been emitted by light source 7 and reflected by the yarns of textile 23 is captured by the CCD camera 6 throughout the inspection. To such an effect each signal (voltage level) from an individual light sensitive element (CCD phototransistor) of the camera is once digitalized assigned a value of a grey level scale. Said values thus form the grey level graph 9 where the grey level is plotted against the axis of ordinates 14 and the inspected length of the garment is plotted against the axis of abscissae 15. Due to the fact that the tension of textile 23 remains essentially uniform on the support or stretcher 1 throughout the inspection the yarn density in said textile 23 is also essentially constant, this resulting in the proportion of light reflected by said yarns and captured by the CCD camera 6 remaining in a grey level graph 9 between an upper threshold 10 an a lower threshold 11, said upper and lower threshold being also constant (see FIG. 4). Wherever there is a flaw in textile 23, said flaw brings about an alteration in the quantity of light reflected by the yarns forming said textile 23, said alteration being captured by the CCD camera 6 and being thus reflected in the grey level graph 9 in form of a peak reaching values above the upper threshold 10 or below the lower threshold 11 depending on the type of flaw having caused the alteration. Thus when the flaw consists in a smaller yarn density in textile 23 as is the case when there is a hole, a rip or a "run" the reflected proportion of light is smaller than the normal one, and therefore a dark flaw peak 12 appears in the grey level graph 9 below the lower threshold 11. On the contrary, if the flaw consists in a clustering of yarns exceeding the usual arrangement the quantity of reflected light will be bigger, and a light flaw peak 13 will appear in the grey level graph 9 above the upper threshold 10.

It is to be finally pointed out that the scope of the invention shall also encompass those variations in details not modifying the essence of the invention, such as in particular the use of mechanical driving assemblies for introducing or withdrawing the garment to be checked onto or from a support with diverse holding means such as a roller, a suction nozzle or a friction generating element such as a resiliently loaded hold-down applied on an area spaced apart from the garment driving area.

We claim:

1. A method for visually inspecting tubular textile garments such as socks, sleeves, stockings, panties or the like, comprising a stage in which the article is loaded onto or unloaded from a support or stretcher, and a stage in which said article is checked by means of a computer-aided vision system operating by means of an image acquisition stage and the processing of said images for the detection of the flaws; characterized in that the inspection is carried out simultaneously with the introduction or egression of the finished article onto or from a stretcher (1), and in that said introduction or egression of the article is carried out in an inspection area (24) while being under a predetermined tension that is kept constant throughout the process and gives the textile (23) a uniform texture such that the distance between two filling or warp yarns is at all times smaller than a portion of any one of the flaws to be detected.

2. A method as in claim 1, characterized in that it comprises the following stages:

image acquisition (16);

image digitalizing (17);

elimination of the texture (18) of the textile (23) through filtering of the image;

extraction (20) of the flaws;

characterization (21) of the flaws by comparison with patterns or standards, and rating (22) of said flaws.

3. A method as in claim 2, characterized in that the extraction (20) of the flaws is carried out by discrimination of those portions of the digitalized image signal assigned to a grey scale level that exceed an upper threshold (10) (light flaw) (13) or a lower threshold (11) (dark flaw) (12) on a grey level scale (14).

4. A method as in claim 1, characterized in that only one side of the garment (2) is examined.

5. A method as in claim 1, characterized in that both sides of the textile (23) of the garment (2) are simultaneously examined.

6. A method as in claim 1, characterized in that the image capturing means and the light source for illuminating the area to be examined (24) remain stationary.

7. A system for visually inspecting tubular textile garments such as socks, stockings, panties or the like, having means to introduce the article to be checked onto a support (1) under a predetermined tension that is a function of every article and is kept constant in an inspection area; image capturing means; and a light source **(7, 7*a*, 8, 8*a*), said image capturing means (6, 6*a*) and light source (7, 7*a*, 8, 8*a*) being stationary, characterized in that said means to introduce the garment (2) to be checked onto the support or stretcher (1) comprises a mechanical driving assembly and a holding assembly which are applied against the garment (2) mounted on the support (1) and assure the application of a predetermined and constant transversal and longitudinal tension to the garment (2) in an area (24) to be scanned, said driving assembly and holding assembly being formed by two rollers (3, 4) applied to the garment (2)** at the ends of the scanning area, said rollers turning at a constant speed.

8. A system as in claim 7, characterized in that the holding means consist of a suction nozzle.

9. A system as in claim 7, characterized in that the holding means consist of friction generating elements applied to an end of the garment (2) distal of the driving assembly.

10. A system as in claim 7, characterized in that the image capturing device (6) and the light source (7) are each located in a different quadrant limited by a plane on which the garment (2) to be examined is stretched and a vertical plane perpendicular to the area to be scanned (24).

11. A system as in claim 10, characterized in that, in the case of transparent articles, it is foreseen in the checking area (24) a totally or partially opaque plane (5), associated to the support (1) or stretcher in such a manner that is interposed between both sides of the garment (2), and in that the image capturing means comprise camera **(6, 6*a*) and light source (7, 7*a*, 8, 8*a*) assemblies both above and below said opaque plain (5), said camera (6, 6*a*) and light source (7, 7*a*, 8, 8*a*)** being located in each side of the article.

12. A system as in claim 7, characterized in that said image capturing means comprises a line or matrix scan CCD or CMOS camera **(6, 6*a*)**.

13. A system as in claim 7, characterized in that the lighting means consist of a high frequency light source such as a fluorescent lamp.

14. A system as in claim 7, characterized in that the lighting means consist of a coherent, monochromatic light source.

15. A system as in claim 7, characterized in that the lighting means consist of a light **(8, 8*a*) arranged behind the camera (6, 6*a*)** and according a ring shape surrounding it.

16. A system as in claim 7, characterized in that the lighting means comprise a continuous light such as a diode light.

17. A system as in claim 7, characterized in that the image acquisition means comprise a filtering modulus intended for the elimination of the texture (18) of the textile in the checking area.

18. A system as in claim 7, characterized in that both image capturing means **(6, 6*a*) and light source (7, 7*a*) assemblies are foreseen in the checking area (24) above and below of the checking area (24) plain, and in that said light sources (7, 7*a*)** are arranged inclined about said plane, in order to avoid the occurrence of glaring phenomena from one to the other side of the garment.

* * * * *